US005636939A

United States Patent [19]

Brown

[11] Patent Number: 5,636,939

[45] Date of Patent: Jun. 10, 1997

[54] SHORELINE EROSION-REVERSING SYSTEM AND METHOD

[76] Inventor: Gregory B. Brown, 105 Blinman St., New London, Conn. 06320

[21] Appl. No.: 467,027

[22] Filed: Jun. 6, 1995

[51] Int. Cl.[6] ..... E02B 3/06

[52] U.S. Cl. ..... 405/30; 405/21; 405/15

[58] Field of Search ..... 405/15–17, 21–22, 405/30–31, 33, 35; 256/13

[56] References Cited

U.S. PATENT DOCUMENTS

| | | | |
|---|---|---|---|
| 133,795 | 12/1872 | Nichols | 256/13 |
| 421,631 | 2/1890 | Sutherland | 405/30 |
| 1,166,580 | 1/1916 | Davies | 405/35 X |
| 1,371,119 | 3/1921 | Scott | 405/35 |
| 1,641,966 | 9/1927 | Farney | 405/35 |
| 1,681,636 | 8/1928 | Farney | 405/35 |
| 3,011,316 | 12/1961 | Wilson . | |
| 3,333,420 | 8/1967 | Henson . | |
| 3,479,824 | 11/1969 | Schaaf et al. . | |
| 3,835,651 | 9/1974 | Butterworth et al. | 405/30 |
| 4,135,843 | 1/1979 | Umemoto et al. . | |
| 4,710,056 | 12/1987 | Parker . | |
| 4,710,057 | 12/1987 | Laier . | |
| 5,024,560 | 6/1991 | Reilly . | |
| 5,064,313 | 11/1991 | Risi et al. . | |
| 5,224,794 | 7/1993 | Atkinson et al. | 405/30 X |
| 5,348,419 | 9/1994 | Bailey et al. . | |

*Primary Examiner*—Tamara L. Graysay
*Assistant Examiner*—Frederick Lagman
*Attorney, Agent, or Firm*—Albert Peter Durigon

[57] ABSTRACT

A shoreline erosion-reversing system and method provides seawards and landwards "quiet" zones which cooperate to promote landwards soil deposition and to mitigate seawards soil scouring. In accord therewith, a series of one or more upstanding, vertically-movable and negatively-buoyant apertured sections are arrayed on a shoreline to be protected. Each section is comprised by a hydrodynamic fence subassembly having a lattice of slats fastened in spaced-apart relation to top and bottom horizontal support members and by a pile subassembly having at least one pile member, which subassemblies cooperate to allow the hydrodynamic fence subassembly to move in a binding-free manner relative to the pile subassembly. The top and bottom horizontal members may be singly and/or doubly arranged and may be implemented with either flexible or rigid members. The slats of the lattice of slats may be singly, doubly and/or triply arranged. End assemblies are disclosed for terminating flexible horizontal support members. Upstanding, vertically-movable negatively- and positively-buoyant apertured sections may be arrayed back-to-back to eliminate overtopping. Sections may be selectably arrayed to prevent flow-around, provide beach access, and, among other things, to go round not easily removable beach objects.

53 Claims, 7 Drawing Sheets

SHORELINE EROSION-REVERSING SYSTEM AND METHOD

FIELD OF THE INVENTION

The present invention is drawn to the field of hydraulic and earth engineering, and more particularly, to a novel shoreline erosion-reversing system and method.

BACKGROUND OF THE INVENTION

Shoreline property though beautified by the presence of the ocean is subject to erosion whenever storms arise which so stir the same ocean as to rage thereagainst, carrying away beach and washing away bank soil and any vegetation growing thereon. The erosion resulting from each storm is undesirable in itself, and where there are structural improvements present at and near the shoreline, such as private beach homes or popular resorts, the resulting erosion may progressively undermine the foundations thereof and thereby threaten the physical integrity of those improvements over time.

Various techniques are known to those skilled in the art of hydraulic and earth engineering for preserving shorelines or other areas subject to the erosive influence of water. So-called "armoring" techniques, such as those of Umemoto et al. U.S. Pat. No. 4,135,843, Reilly U.S. Pat. No. 5,024,560, and Risi et al. U.S. Pat. No. 5,064,313, have attempted to prevent shoreline erosion by so fortifying the shoreline with blocks, cement and the like as to form a prophylactic layer over the region of the shoreline that would otherwise be subject to the erosive effects of the moving water. Due to their weight and bulk, such armoring techniques are often difficult to install, and often result in permanent structures that cannot be taken down or put up seasonably or at will. Often, they are so configured as to prevent the enjoyment of the region of the shoreline that they overlay. Moreover, there is the difficulty of being able to adequately anchor the armor to the underlying soil, whether beach, bank or both. Water incident to the layer is accelerated in such way as to wash away beach at the beach/armor interface. The prophylactic layer itself is thereby subjected to being washed away in a severe storm.

Jetties are also known for attempting to control shoreline erosion. As is well known to those skilled in the art, each shoreline has a natural direction and flow rate in accord with which it migrates, and in the typical case, a stone or other permanent formation is build into the shore in such a manner as to form a jetty traverse the natural flow direction of the shoreline. While they have the advantageous effect of promoting local soil deposition, they suffer from the disadvantage of downstream and upstream soil erosion, and, if too many jetties are installed along a given region of shoreline, they may alter the dynamic equilibrium of the shoreline and undesirably change the shape of the beach as a whole. During storms, although they refract and thus dissipate the energy and direction of the incoming waterwaves, jetties generally have only a secondary impact insofar as storm damage control is concerned.

A third and last category of shore and bank protection techniques have attempted to control erosion by attenuating the energy, velocity, and/or direction of a potentially erosive fluid such as the sea or a river as exemplified in Schaaf et al. U.S. Pat. No. 3,479,824, Wilson U.S. Pat. No. 3,011,316, Henson U.S. Pat. No. 3,333,420, Bailey et al. U.S. Pat. No. 5,348,419, Parker U.S. Pat. No. 4,710,056 and Laier U.S. Pat. No. 4,710,057. The Shaaf et al. seawall and fence construction discloses one or more concrete panels having apertures therethrough that are pivotally hung on piles to attenuate the energy of the sea incident thereto. The Wilson breakwater and method of dissipating waves discloses spaced-apart confronting panels having louvers so arranged as to trap therebetween, and turbulently cancel, the energy of sea water that moves through the louvers The trap is installed in the body of the moving water off shore of the shoreline to be protected. The method and system for controlling the course of a river of Henson and the system for erosion control of Bailey et al. respectively disclose a slat fence and a criss-cross web defining selectable permeabilities slidably hung on piles driven into a river bed such that the criss-cross webs or slat fences are generally traverse the flow direction of the river. The criss-cross webs or slat fences cause, on the one hand, soil to deposit along the inner bank and cause, on the other hand, the thalweg of the river to be moved towards the opposite, outer bank. The method and apparatus for restoring a beach of Parker discloses one or more rows of nets installed on a shoreline to be protected such that the direction of extension of the nets is generally perpendicular to the shoreline to be protected and extends from the high tide to the low tide marks. The method and apparatus for building up beaches and shorelines of Laier discloses a system of plural, interconnected compartments disposed underwater on the seabed of the shoreline to be protected.

SUMMARY OF THE INVENTION

The present invention discloses as its principal object a novel shoreline, storm-erosion-reversing system and method which so controls the action of storms as to not only prevent soil erosion but also to allow soil deposition during a storm.

Storms typically cycle through a build-up phase, a phase of maximum intensity, and a phase of decline, and the present invention discloses as one of its related objects a shoreline erosion-reversing system and method which so controls the action of storms as to not only prevent soil erosion but also to allow soil deposition in such a way that its controlling action follows the natural storm cycle, imparting more and less controlling action as a storm builds and recedes, and maximum controlling action at the peak of the storm.

Storms typically rage unchecked about a shoreline and the present invention discloses as another related object a novel shoreline erosion-reversing system and method which so controls the action of storms proportionally to their intensity as to prevent soil erosion and promote soil deposition in such a way that "quiet" zones, regions where the rage of the storm is substantially attenuated, are created and maintained during the course of a natural storm cycle in both seaward and landward directions.

In accord with these and other objects, the shoreline erosion-reversing system of the present invention comprises a series of one or more upstanding, vertically-movable and negatively-buoyant apertured sections having generally quadrilateral front and rear faces and a bottom edge, whose bottom edges always rest on the underlying seashore, which sections are so arrayed on the shoreline to be protected that the front faces of at least one section generally faces seaward and the corresponding rear face of each such at least one section generally faces landward to confront an upstanding element, such as a bank or another section, in spaced-apart relation therewith to define a basin therebetween; each such at least one upstanding section has a first solid portion which acts to attenuate upon impact the energy of the waterwaves of a storm; each such upstanding apertured section both has first apertures that permit a portion of the water of the waterwaves of a storm incident to each such section to pass therethrough to the basin in proportion to the intensity of the storm and has second solid portions cooperative therewith to temporarily retain the same in the basin so as to provide a body of water in the basin whose mass at any time varies with the intensity of the incident storm and whose inertia dissipates the energy of the waterwaves of a storm as the inertial mass of water is moved thereby in proportion to its intensity creating a landward "quiet" zone between each such section and its corresponding upstanding element in which soil entrained in the body of water temporarily held in the basin deposits on the landward side of each such section; and each such section has second apertures that allow the water in the basin to flow from the basin seaward back through each such section and into the oncoming water of the storm as a back-current which turbulently cancels the same creating a "quiet" zone seaward of each such section in which erosive effects of the storm are mitigated.

In the presently preferred embodiments, the upstanding, vertically-movable and negatively-buoyant apertured sections of the shoreline erosion-reversing system and method of the present invention are comprised by a pile subassembly having at least one pile member driven into the shoreline to be protected, and a negatively-buoyant hydrodynamic fence subassembly so mounted to the pile subassembly that the hydrodynamic fence subassembly is upstanding and is always free to vertically slide into bearing contact with the underlying seashore whether the same is level or sloping. The sections may be linearly arrayed, arcuately arrayed, and/or arrayed to provide intersecting, at right, acute or oblique angles, or spaced-apart, section portions, which, among other things, prevents flow-around, accommodates beach traffic, and conforms to different beach topologies. Single- and double-pile embodiments of the pile subassembly are disclosed.

The negatively-buoyant hydrodynamic fence subassembly in the disclosed embodiments includes a lattice comprised of upstanding slats that are mounted in spaced-apart relation to top and bottom horizontal support members. Each slat has a top and a bottom and each defines a first solid portion extending from the top to the bottom and a second solid portion extending from the bottom to the top, the changeover therebetween being determined by the level of water of an incident storm as it rises and lowers in accord with a natural storm cycle. Laterally adjacent spaced-apart slats define an interspace therebetween, and each interspace defines, together with the level of the water of an incident storm, a first apertured portion that extends from the top towards the bottom and a second apertured portion that extends from the bottom to the top, the changeover therebetween being determined by the phase of the natural storm cycle. The lattice may be arrayed of single-, double- and/or triple-slats which may be affixed to the horizontal support members by welds, mechanical fixtures, threading, weaving, and/or by wire-wrapping, among others. The horizontal support members may be singly- and/or doubly-arrayed and may be either rigid members, such as lengths of pipe, or flexible members, such as cables. Where rigid horizontal support members are employed, adjacent sections are unconnected but may be overlapping. Where flexible horizontal support members are employed, end pile subassemblies are disclosed for providing end termination of the cable or other flexible horizontal support members in such a way as to allow the hydrodynamic fence sections to fall as the soil is scoured out thereunder during a storm.

Further in accord with these and other objects of the present invention, the shoreline erosion-reversing method of the present invention comprises the steps of arraying a series of one or more upstanding, negatively-buoyant and vertically-movable apertured sections having generally quadrilateral front and rear faces, a bottom edge, first and second solid portions and first and second apertured portions on the shoreline to be protected in such a way that the front faces of at least one section generally faces seaward, the bottom edge of each of said at least one upstanding, negatively-buoyant and vertically-movable apertured section rests on the underlying shoreline, and the corresponding rear face of each such at least one section faces landward and confronts an upstanding element, either natural or man-made, in spaced-apart relation therewith to define a basin therebetween; allowing the waterwaves of a storm to impact the first solid portions of said at least one upstanding, apertured section so as to attenuate the energy of the waterwaves of a storm; allowing the water of the waterwaves of the storm incident to each such section to pass through the first apertured portions of each such at least one section into the basin in proportion to the intensity of the storm while allowing the second solid portions of each such at least one apertured section to temporarily retain the same in the basin and form thereby a body of water in the basin whose mass at any time varies with the intensity of the incident storm and whose inertia dissipates the energy of the waterwaves of the storm as the inertial body of water in the basin is moved thereby in proportion to the intensity of the storm creating a landward "quiet" zone between each such section and the corresponding upstanding element in which soil entrapped in the body of water temporarily held in the basin is deposited on the landward side of each such at least one apertured section; and allowing the second apertured portions of each such at least one apertured section to pass the water in the basin back from the basin seaward back through each such at least one apertured section and into the oncoming waterwaves of the storm forming thereby a back-current which turbulently cancels the same creating a "quiet" zone seaward of each such section which mitigates shoreline erosion seaward of each said at least one apertured section.

BRIEF DESCRIPTION OF THE DRAWINGS

Other objects, advantageous features and inventive aspects of the present invention will become apparent as the invention becomes better understood by referring to the following detailed description of the preferred embodiments thereof, and to the drawings, wherein.

DETAILED DESCRIPTION OF THE PREFERRED EMBODIMENTS

Figure 1:
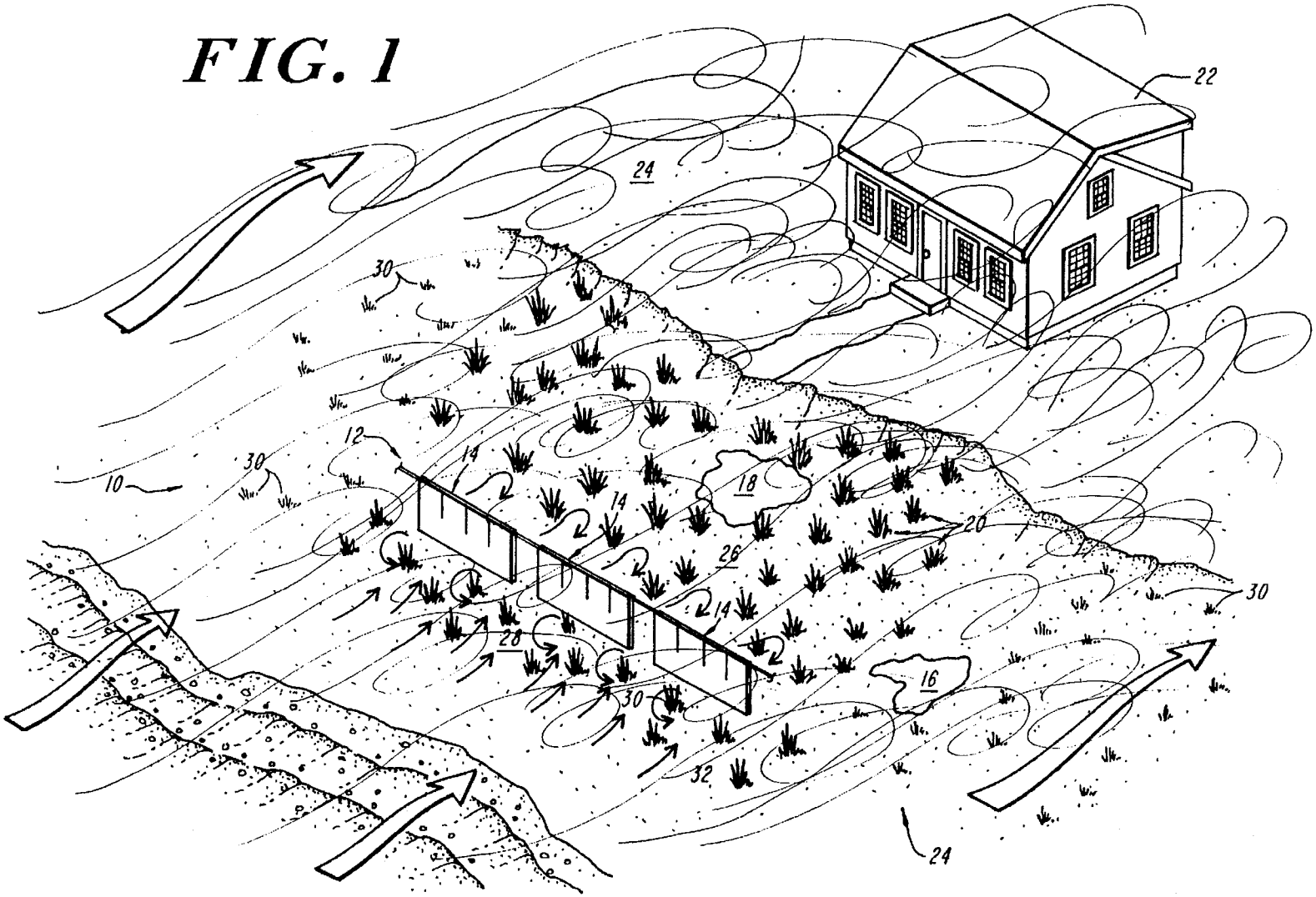
FIG. 1 is a pictorial view of the shoreline erosion-reversing system and method of the present invention illustrating the seaward and landward "quiet" zones.

Referring now to FIG. 1, generally designated at 10 is a pictorial view of the shoreline erosion-reversing system and method of the present invention. A linear array generally designated 12 of one or more upstanding, vertically-movable and negatively-buoyant apertured sections generally designated 14 is provided on a shoreline 16 to be protected in such a way that the front faces of each of the sections 14 face seaward and the corresponding rear faces of each of the sections 14 face landward and confront an embankment 18. Vegetation generally designated 20 grows on embankment 18 and a house 22 on embankment 18 overlooks the shore.

A storm generally designated 24 is shown raging about the shore 16 and about the array 12 of sections 14. The array 12 of upstanding vertically-movable and negatively-buoyant apertured sections 14 operates in a manner described below to provide both a landward quiet zone generally designated 26 and a seaward quiet zone generally designated 28 respectively to the front and rear sides of the array 12 of sections 14. As illustrated, vegetation 20 on the embankment 18 within the landward quiet zone 26 is protected from the rage of the storm 24, while vegetation outside of the quiet zone 26 to either lateral side thereof has been washed off of the embankment 18 by action of the storm. As appears more fully below, the landward quiet zone 26 not only prevents erosion of the embankment 18 contiguous therewith but also defines a region where soil is deposited. The quiet created by the landward quiet zone 26 not only preserves the vegetation and promotes soil deposition but it thereby prevents any threat to the foundation of any improvements such as the house 22 on top the embankment 18.

The seaward quiet zone 28 extends in front of the array 12 of upstanding, vertically-movable and negatively-buoyant apertured sections 14. As appears more fully below, the array 12 operates in storm 24 to provide a current of water 30 that flows back to the sea and turbulently cancels the oncoming waterwaves 32. In the seaward quiet zone 28, soil deposition is promoted due to the quieting, and the effects of shoreline erosion are mitigated to a large extent.

Figure 2:
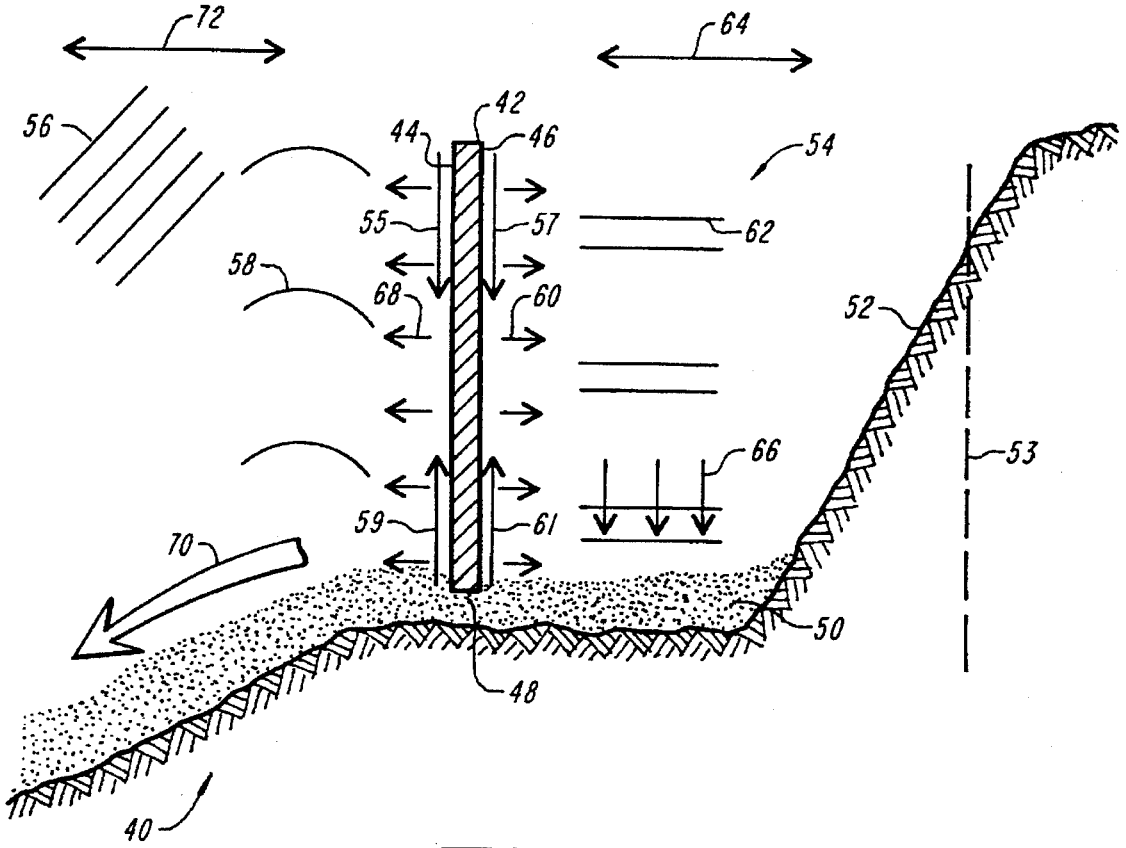
FIG. 2 is a schematic diagram useful in explaining the principles of operation of the shoreline erosion-reversing system and method of the present invention.

Referring now to FIG. 2, generally designated at 40 is a schematic diagram useful in explaining the principles of operation of the shoreline erosion-reversing system and method of the present invention. Rectangle 42 schematically illustrates one section of the series of one or more upstanding, vertically-movable and negatively-buoyant apertured sections of the present invention with its front face 44 facing seawards, its rear face 46 facing landwards and with its bottom edge 48 resting on, and always supported by, the sandy shore 50 of the shoreline to be protected. The illustrated section 42 of the array of one or more upstanding, vertically-movable and negatively-buoyant apertured sections is placed on the shore 50 such that its rear face 46 is spaced from and confronts an upstanding appurtenance 52, such as a hillside, defining a basin generally designated 54 therebetween. The appurtenance 52 may be a man-made element as well, such as another upstanding, vertically-movable and negatively-buoyant apertured section illustrated by dashed line 53, without departing from the inventive concepts. The placement of the section 42 in relation to the appurtenance 52 is determined by the following important considerations. The sections are placed on the one hand close enough to the appurtenance to provide a volume of water in the basin whose inertial mass in a storm is adequate to provide landward and seaward quiet zones and on the other far enough away therefrom that the motion of the volume of water in the basin does not materially degrade the appurtenance.

A storm represented by parallel lines 56 is shown incident to the section 42. The storm 56 follows a storm cycle whereby it progresses through a period of low intensity, maximum intensity and low intensity again as it dies out, so that more and less water is incident to the section 42 depending on the phase of the storm as illustrated by the concave sections 58. Each section 42 of the array of apertured sections has first solid potions schematically illustrated by arrow 55 that extent from the top thereof towards the bottom, second solid portions schematically illustrated by arrow 59 that extend from the bottom thereof towards the top, first apertured portions schematically illustrated by arrow 57 that extends from the top thereof towards the bottom and second apertured portions schematically illustrated by arrow 61 that extent from the bottom thereof towards the top. As appears more fully below, in the presently preferred embodiments, the section 42 is comprised of a hydrodynamic fence subassembly having a lattice of upstanding slats mounted in spaced-apart relation to top and bottom horizontal support members and defining interspaces between laterally adjacent slats. In the presently preferred embodiments, the first solid portions correspond to the portions of the slats of the lattice that extent from the top towards the bottom thereof, the second solid portions correspond to the portion of the slats that extends from the bottom towards the top thereof, the first apertured portions correspond to the portion of the interspaces that extend from the top towards the bottom thereof and the second apertured portions correspond to the portion of the interspaces that extend from the bottom towards the top thereof, although it will be appreciated that other first and second solid and apertured portions may be employed as well without departing from the inventive concepts.

Depending on the level 58 of the waterwaves 56 of the storm impacting the section 42, the first solid portions 55 of the section 42 act to attenuate upon impact the energy of the waterwaves 56 of the storm in proportion to the intensity of the storm. The length of the first solid portions 55 is selected to accommodate the range of swell of the waterwaves of a typical storm as illustrated by the concave curves 58, and, although the first solid portions 55 in the presently preferred embodiments described hereinbelow are constituted by the upper portions of the slats of the lattice of slats of the hydrodynamic fence subassemblies, other first solid portion geometries may be employed as well without departing from the inventive concepts.

Depending on the level 58 of the waterwaves 56 of the storm impacting the section 42, a quantity of the incident waterwaves 58 proportional to the intensity of the storm 56 is passed through the first apertured portions 57 of the section 42 and into the basin 54 as illustrated by the arrows 60. The second solid portions 59 of the section 42, since the bottom edge of the section 42 is always resting on the underlying sand 50, cooperate with the first apertured portions 57 to temporarily retain a body of water in the basin 54 whose mass and inertia varies with the intensity of the storm as illustrated by the arrows 62. As the waterwaves 58 of the storm 56 that pass through the first apertured portions 57 of the section 42 move the inertial mass of the body of water 62 in the basin 54, its energy is dissipated as the inertial mass of water in the basin is moved thereby in proportion to the intensity of the storm. In a typical case, the motion of the body of water is turbulent, where local velocities and pressures fluctuate randomly. The greater the intensity of the storm, the larger is the quantity of water temporarily held in the basin, and the more the energy of the storm is dissipated by moving that inertial mass of water. The lengths of the cooperative first apertured portions 57 and second solid portions 59 are selected to accommodate the range of swell of the waterwaves of a typical storm as illustrated by the concave curves 58, and, although the first apertured portions 57 in the presently preferred embodiments described hereinbelow are constituted by the upper portions of the interslat interspaces of the slats of the lattice of slats of the hydrodynamic fence subassemblies and the second solid portions are constituted by the lower portions of the slats of the lattice of slats of the hydrodynamic fence subassemblies, other first apertured and second solid portion geometries may be employed as well without departing from the inventive concepts. The attenuation of the waterwaves 58 of the storm 56 by impact on the first solid portions 55 of the section 42 and the absorption of its energy by the motion of the inertial mass of water 62 in the basin 54 induced thereby in proportion to its intensity create a quiet zone illustrated by arrow 64 between the section 42 and the hillside 52. In the quiet zone 64, entrained soil in the water 62 of the basin 54 deposits behind the section 42 as illustrated by arrows 66 building up the shore rearwardly of the section 42.

The water 62 in the basin 54 flows seaward back through the second apertured portion 61 of the section 42 as illustrated by arrows 68 and creates a current 70 that rushes into the oncoming waterwaves 58 of the storm 56. The force of the current 70 varies with the level of water 62 in the basin 54, and thus with the intensity of the storm 56, so as to turbulently cancel the oncoming waterwaves with greater effect if the storm is raging at full strength and with proportionally less effect during the buildup and decline stages. The turbulent cancelling of the incoming waterways 58 by the current 70 produces a quiet zone seaward of the section 42 as illustrated by a double-headed arrow 72 in which shoreline erosion is mitigated and soil deposition is promoted. The length of the second apertured portions 61 is selected to accommodate the range of water build up 62 in the basin 54 and, although the second apertured portions 61 in the presently preferred embodiments described hereinbelow are constituted by the lower portions of the interslat interspaces of the slats of the lattice of slats of the hydrodynamic fence subassemblies, other second apertured portion geometries may be employed as well without departing from the inventive concepts.

Figure 3:
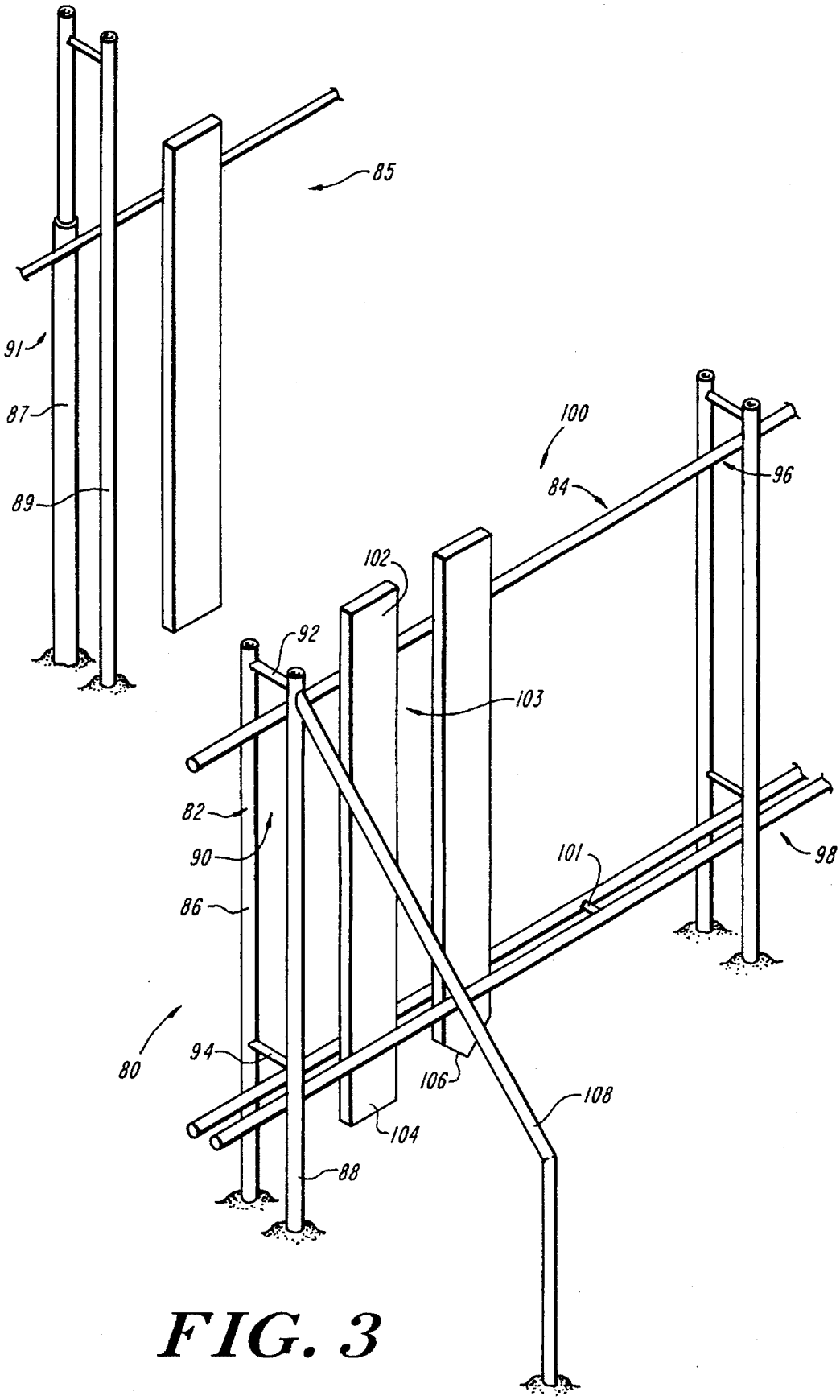
FIG. 3 is a perspective view illustrating a double pile embodiment implemented either with rigid or with flexible horizontal support members of the upstanding, vertically-movable and negatively-buoyant apertured sections of the shoreline erosion-reversing system and method of the present invention.

Referring now to FIG. 3, generally designated at 80 is a perspective view of a double pile embodiment implemented either with rigid or with flexible horizontal support members of the upstanding, vertically-movable and negatively-buoyant apertured sections of the shoreline erosion-reversing system and method of the present invention. The assembly 80 is comprised of a double pile subassembly generally designated 82 and a vertically-movable and negatively-buoyant hydrodynamic fence subassembly generally designated 84. The double pile subassembly 82 is comprised of first and second confronting, spaced-apart piles 86, 88, which are driven into the shoreline to be protected and which define an interspace therebetween generally designated 90. The interspace 90 has a preselected extension selected to permit free, binding-free vertical motion of the vertically-movable and negatively buoyant hydrodynamic fence subassembly 82. The piles 86, 88 of each pile subassembly 82 are connected in spaced apart relation by ties 92, 94, as needed, to ensure their mechanical rigidity. The ties 92, 94 may be welded or mechanically fixtured or otherwise secured to the piles 86, 88. In a typical case, the piles are anywhere from eight (8) to twenty-five (25) feet in length, are driven into the seashore from about four (4) feet to a maximum of one-half the longer piling lengths, and are spaced apart from about ten (10) to about fifteen (15) feet.

Each upstanding, vertically-movable and negatively-buoyant fence subassembly 84 is comprised by a top horizontal support member generally designated 96, a bottom horizontal support member generally designated 98 and a lattice generally designated 100 consisting of slats 102 connected in a manner to be described to the top horizontal support member 96 and to the bottom horizontal support member 98 at points therealong so spaced apart, either evenly or unevenly, that apertures generally designated 103 are formed between adjacent slats 102. The horizontal members 96, 98 may be rigid or flexible, as appears more fully below, such as sections of pipe or cable, and may be arranged either singly, as illustrated for the horizontal member 96, or arranged in lateral pairs, as illustrated by the horizontal member 98. When pairs of horizontal support members are employed, they may be tied together by braces 101, either welds or mechanically attached, as necessary to maintain their mechanical integrity. The slats 102 of the lattice 100, as appears more fully below, may be singly, doubly, and/or triply arrayed, and may be fastened to the upper and lower horizontal support members 96, 98 of the vertically-movable and negatively-buoyant hydrodynamic fence subassembly 84 by means, such as bolts, welds, threading, cabling, and weaving, as appears more fully below. In a typical case, each section may be from about one (1) foot to about fifteen (15) feet high and from about three (3) feet to about thirty (30) feet in length for sections implemented with rigid horizontal support members, and anywhere from a few feet to an indefinite length for sections implemented with flexible horizontal support members.

Some or all of the slats 102 may have their bottom edges sharpened as at 106 to promote settling of the bottom edge of each hydrodynamic fence subassembly 84 into the sandy soil underlying the same. Sharpening may take other forms as well without departing from the inventive concepts, such as front to back bevels, not shown. Sharpening may be important to always maintain contact of the bottom edge of the hydrodynamic fence subassembly 84 with the underlying shore, especially when the beach falls away unevenly thereunder. In such a case, loading is proportionately greater at the sharpened ends in contact with the beach allowing the same to more easily seat itself into the uneven soil until there are no gaps between the uneven shore and the bottom edge of the hydrodynamic fence subassembly. Should the hydrodynamic fence subassembly 84 cant during the course of a storm, the sharpened bottoms 104 of the slats 102 of the lattice 100 in contact with the underlying shore would sink thereinto more readily, thereby insuring that the bottom of the vertically-movable and negatively-buoyant subassemblies 84 always remains in abutting relation with the soil notwithstanding the canting action of the subassemblies.

Braces 108, either flexible or rigid, may be provided to either or both sides of the pile subassemblies 82 to mechanically support the piles 86, 88 thereof in place on the shoreline to be protected. Ballast, not shown, may be attached to the hydrodynamic fence subassemblies 84 to ensure their negative buoyancy in seawater.

The horizontal members 96 and 98 of the hydrodynamic fence subassembly 84 are disposed through the interface 90 of the pile subassemblies 82 and are constrained by the double piles 86, 88, which, on the one hand, maintain each hydrodynamic fence subassembly in an upstanding position, and which, on the other hand, provide a linear bearing along which each hydrodynamic fence subassembly is free to slide up and down in the vertical direction. The bottom edges 104 of the slats 102 of the lattice 100 of each vertically-movable and negatively-buoyant subassembly 84 thus always rest upon, and are borne up by, the underlying shore. In a storm, as the beach under each section falls, so do the sections 84, whereby each section maintains contiguity with the underlying beach. In a typical storm, the beach may fall away from zero (0) to about five (5) feet, and more. Whenever soil deposition occurs in the landward and seaward quiet zones as a result of a storm, sections 84 may be lifted manually to reseat them upon the shore and thereby ready them for the next storm.

When pile subassemblies 82 are provided at points along a hydrodynamic fence subassembly 84 implemented with a single horizontal support member, a slider surface, not shown, mounted to the confronting portion of the lattice of slats, is provided between one of the piles and the unsupported side of the slats to provide free motion therebetween.

The hydrodynamic fence subassembly 84 of the double pile embodiment 80 may be implemented with either rigid or flexible horizontal support members 96, 98. When rigid horizontal support members 96, 98 are selected, each hydrodynamic fence subassembly 84 is supported by two or more pile subassemblies 82, which may, but need not be, located at and near the ends of each section. When flexible horizontal support members 96, 98 are selected, and multiple hydrodynamic fence subassemblies are arrayed on a shoreline to be protected, some hydrodynamic fence subassemblies will constitute "end" sections while others will constitute sections which are intermediate the end sections. As appears more fully below, end termination assemblies are disclosed which allow both end and intermediate sections implemented with flexible horizontal support members to vertically move at all times and for all conditions of even and uneven soil underlying each section.

In a storm, the solid portion of the slats 102 extending above the water of the storm at any given phase thereof act to absorb the energy of the incoming waterwaves by impact therewith. A portion of the water of the waterwaves of the storm incident thereto passes through the portion of the apertures 103 that are above the level of the water at any given time, as well as through the portions thereof that are underwater, but to a lesser extent, at any phase of the storm. A body of water whose quantity varies with the intensity of the storm is reservoired by action of the solid portions of the slats 102 of the lattice 100 of the hydrodynamic fence subassemblies 84 that are underwater at any given phase of the storm in the basin of water behind each fence, which inertial body of water dissipates the energy of the waterwaves of the storm as it is moved by the storm in direct proportion to its intensity. A quiet zone landward of each hydrodynamic fence subassembly is thereby created in which soil deposition occurs as described above and in which any vegetation and the like is protected against the otherwise erosive effects of the storm. A portion of the water in the basin flows back through the underwater portions of the apertures 103 of the hydrodynamic fence subassemblies 84 providing thereby a back-current which, as described above, turbulently cancels the energy of the waterwaves of the incident storm in direct proportion to its intensity creating a seaward quiet zone in which the otherwise erosive effects of the storm are mitigated.

Another section generally designated 85 may be arranged back-to-back with the section 80, which, unlike the section 80, is positively buoyant, and is arranged on hyper-extended piles 87, 89 of pile subassembly generally designated 91. Any suitable means to provide positive buoyancy in seawater, such as flotation attachments, not shown, may be employed without departing from the inventive concepts. The piles 87, 89 may be telescoping instead of hyperextended as illustrated for the pile 87. Telescoping piles are advantageous insofar as a compact pile assembly is thereby provided. In a storm, as the negatively buoyant section drops, the positively buoyant section 85 can rise with storm surges, whereby overtopping is effectively eliminated. The back-to-back sections 80, 85 may be interconnected to provide strength.

Figure 4:
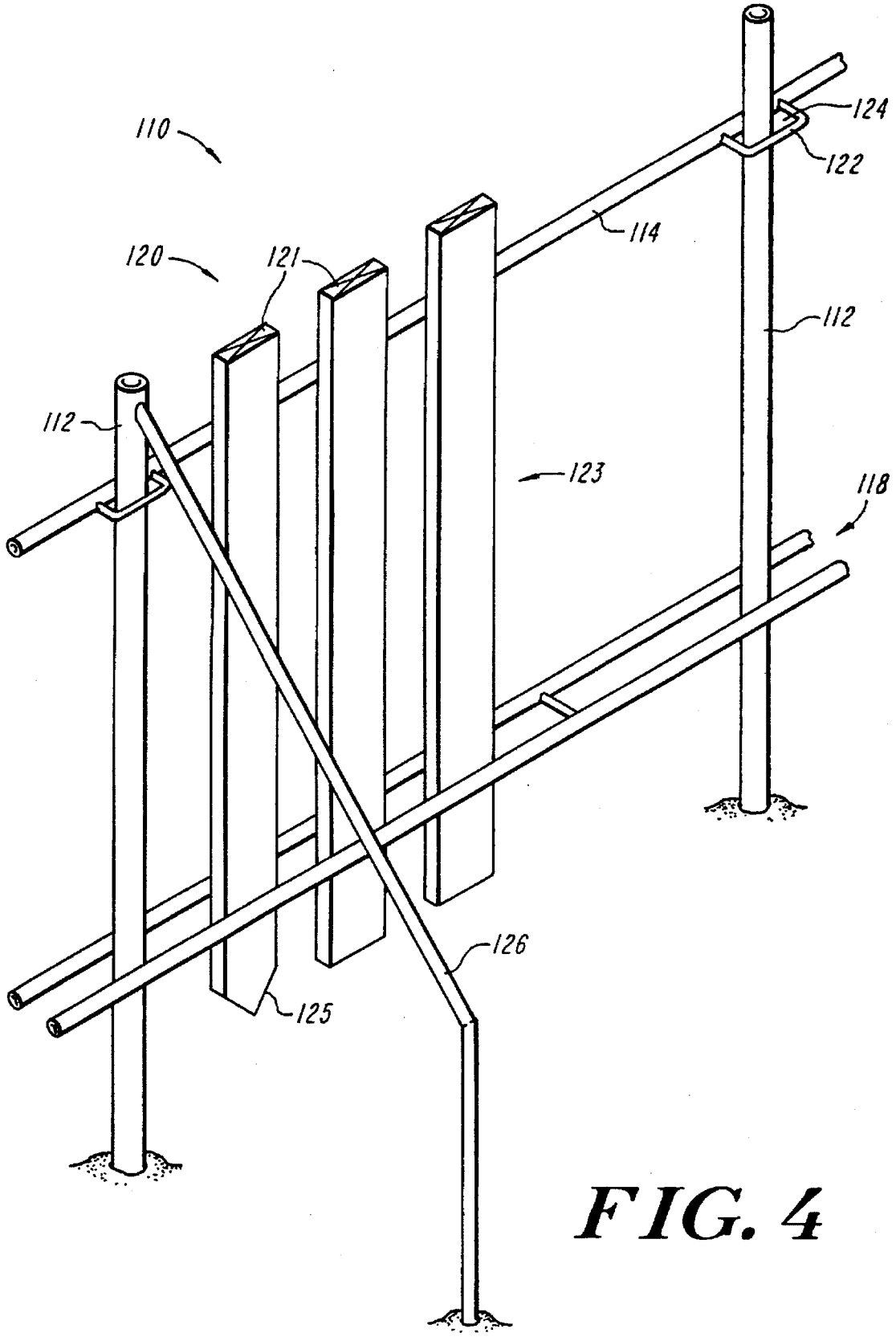
FIG. 4 is a perspective view illustrating a single pile embodiment implemented either with rigid or with flexible horizontal support members of the upstanding, vertically-movable and negatively-buoyant apertured sections of the shoreline erosion-reversing system and method of the present invention.

Referring now to FIG. 4, generally designated at 110 is a perspective view of a single pile embodiment implemented either with rigid or with flexible horizontal support members of the upstanding, vertically-movable and negatively-buoyant apertured sections of the shoreline erosion-reversing system and method of the present invention. The assembly 110 includes a pile subassembly generally designated 112 and a vertically-movable and negatively-buoyant fence subassembly generally designated 114. Each pile subassembly 112 consists of a single rod 116 driven into the shoreline. The pile subassemblies 112, like the pile assemblies 82 of the embodiment of FIG. 3, are spaced-apart along the shoreline, as needed, to accommodate the loading of one or more upstanding, vertically-movable and negatively-buoyant fence subassemblies. In a typical case, the piles are anywhere from eight (8) to twenty-five (25) feet in length, are driven into the seashore from about four (4) feet to a maximum of one-half the longer piling lengths, and are spaced apart from about ten (10) to about fifteen (15) feet.

The fence subassemblies 114 are comprised of a top horizontal support member generally designated 116 and a bottom horizontal member generally designated 118 to which a lattice 120 of slats 121 are fastened in spaced-apart relation and provide interslat interspaces generally designated 123. As for the embodiment 80 of FIG. 3, the horizontal support members 116, 118 may be composed of rigid lengths of pipe, or flexible cable, and may be configured either singly, as illustrated for the member 116, or doubly, as illustrated for the member 118. The slats 121 of the lattice 120 may be spaced apart in a single row, as illustrated, and as appears more fully below, may be mounted in pairs, or even in three's, at points spaced-apart either evenly or unevenly along the length of the support members 116, 118. The lattice elements 120 may be fastened to the support members 116, 118 in spaced-apart relation therealong by means, such as bolts, or clamps, welds, or by threading, weaving, and, among others, by wire-wrapping as appears more fully below.

When rigid horizontal support members 114, 116 are selected, each hydrodynamic fence subassembly 114 is supported by two or more pile subassemblies 112, which may, but need not be, located at and near the ends of each section. When flexible horizontal support members 114, 116 are selected, and multiple hydrodynamic fence subassemblies are arrayed on a shoreline to be protected, some hydrodynamic fence subassemblies will constitute "end" sections while others will constitute sections which are intermediate the end sections. As appears more fully below, end termination assemblies are disclosed which allow both end and intermediate sections to vertically move at all times and for all conditions of even and uneven soil underlying each section.

The upstanding, vertically-movable and negatively-buoyant apertured sections 114 are mounted for sliding motion to at least some of the single piles 112 by means of a U-shaped connecting member 122 welded or mechanically fastened or otherwise attached to the upper horizontal support member 116, or to the lower horizontal member 118, or both. The member 122 may be slidably mounted to the horizontal member 114, such as on a sleeve, not shown, whereby any tension loading that would otherwise occur thereon is relieved. The U-shaped connecting member 122 defines a U-shaped channel generally designated 124 that surrounds the single pile 112, capturing the same. The member 122 and the channel 124 on the one hand maintain each hydrodynamic fence subassembly in an upstanding position and on the other hand provides a linear bearing along which each upstanding hydrodynamic fence subassembly 114 is able to slide upwardly and downwardly thereon in the vertical direction free from any binding action.

Some or all of the slats 121 may have their bottom edges sharpened as at 125 to promote settling of the bottom edge of each hydrodynamic fence subassembly 114 into the sandy soil underlying the same. Sharpening may take other forms as well without departing from the inventive concepts, such as front to back bevels, not shown. Sharpening may be important to always maintain contact of the bottom edge of the hydrodynamic fence subassembly 114 with the underlying shore, especially when the beach falls away unevenly thereunder. In such a case, loading is proportionately greater at the sharpened ends in contact with the beach allowing the same to more easily seat itself into the uneven soil until there are no gaps between the uneven shore and the bottom edge of the hydrodynamic fence subassembly. Should the hydrodynamic fence subassembly 114 cant during the course of a storm, the sharpened bottoms 125 of the slats 121 of the lattice 120 in contact with the underlying shore would sink thereinto more readily, thereby insuring that the bottom of the vertically-movable and negatively-buoyant subassemblies 114 always remains in abutting relation with the soil notwithstanding the canting action of the subassemblies.

Braces 126, either rigid or flexible, may be provided to either or both sides of the pile subassemblies 112 to mechanically support the piles 116 thereof in place on the shoreline to be protected. Ballast, not shown, may be attached to the hydrodynamic fence subassemblies 114 to ensure their negative buoyancy in seawater.

In a storm, the action of the embodiment 110 is the same as that of the embodiment 80 of FIG. 3 and is not described again herein for the sake of brevity of explication.

Figure 5A:
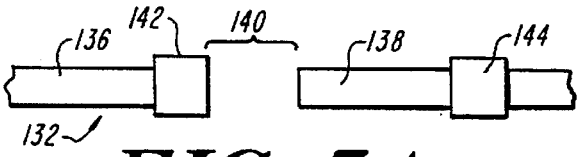
FIG. 5 are schematic plan views illustrating in the FIGS. 5A and 5B thereof different interfaces between laterally adjacent upstanding, vertically-movable and negatively-buoyant apertured sections implemented with rigid horizontal support members of the shoreline erosion-reversing system and method of the present invention.
Figure 5B:
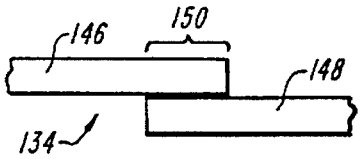

Referring now to FIG. 5, generally designated at 132 in FIG. 5A and at 134 in FIG. 5B are schematic plan views illustrating different manners by which laterally adjacent upstanding, vertically-movable and negatively-buoyant apertured sections implemented with rigid horizontal support members may be interfaced of the shoreline erosion-reversing system and method of the present invention. As shown at 132 in FIG. 5A, sections 136, 138 having hydrodynamic fence subassemblies implemented with rigid horizontal support members are separated by a gap 140 therebetween. Pile 142 is shown located at the end of section 136, while a pile 144 is shown located spaced from the end of the section 138. The length of the section 138 between its end confronting the section 134 and the pile 144 is a free end.

As shown at 134 in FIG. 5B, adjacent lateral sections 146, 148, while, like in the FIG. 5, they are not connected, they are positioned out of a common plane, so that their ends overlap in a region illustrated by a bracket 150.

Figure 6A:
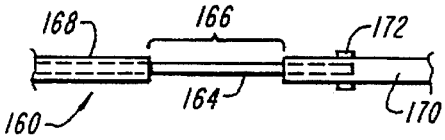
FIG. 6 are schematic plan views illustrating in the FIG. 6A and 6B thereof different interconnections between laterally adjacent, upstanding, vertically-movable and negatively-buoyant sections implemented with rigid horizontal support members of the shoreline erosion-reversing system and method of the present invention.
Figure 6B:
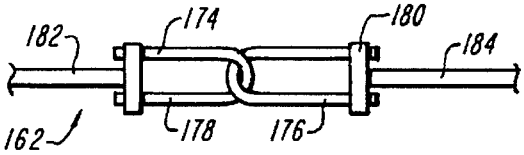

Referring now to FIG. 6, generally designated at 160 in FIG. 6A and at 162 in FIG. 6B are schematic plan views illustrating different manners by which laterally adjacent upstanding, vertically-movable and negatively-buoyant apertured sections implemented with rigid support members may be interconnected of the shoreline erosion-reversing system and method of the present invention. As shown at 160 in FIG. 6A, a length of cable 164, longer than the interspace indicated by bracket 166 by about a factor of three (3), which may vary with the stiffness of the cable and the expected differential settling of the sections connected thereby, is slidably received in the confronting, but spaced-apart, open ends of the horizontal support members 168, 170 implemented with rigid pipes of laterally adjacent, upstanding, vertically-movable and negatively-buoyant apertured sections. The ends of the flexible cable 166 may be friction-fit in either or both of the open ends of the confronting members 168, 170, or the ends of the flexible cable 166 may be mechanically fastened thereto, as by a fastener 172. Depending on whether the cable 164 is mechanically fastened to either, both, or neither of the members 168, 170, the laterally adjacent members 168, 170 are able to move relative to each other as the cable 164 slides within either or both corresponding open ends into which it is friction-fit or as it buckles in the interspace 166 between adjacent sections to which it is mechanically fastened. The cable 164 thus provides a stiff, but flexible interconnection, which ensures continuity between adjoining sections, to which slats, not shown, may be added.

As shown at 162 in FIG. 6B, interlocking loop members 174, 176 provide continuity and added strength between the confronting ends of horizontal support members 182, 184 of laterally adjacent upstanding vertically-movable and negatively-buoyant apertured sections implemented with rigid horizontal support members of the shoreline erosion-reversing system and method of the present invention. The loop members 174, 176 may be fastened, as by welds or mechanical fasteners 178, 180, to the confronting ends such that the length of the interlocking loops 174, 176 provides the free play in which the laterally adjacent sections may move relative to each other, or may be fastened to sleeves, not shown, slidably mounted on either or both horizontal support members and retained thereon by flanges, not shown, attached to the ends thereof.

Figure 7A:
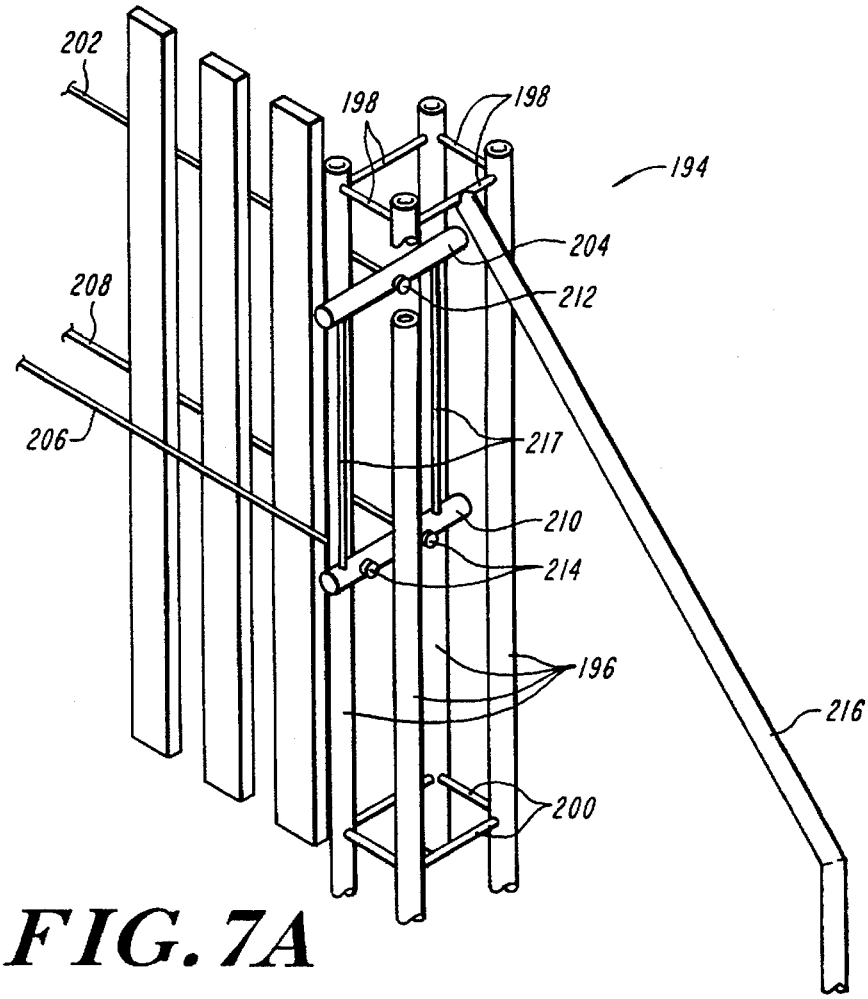
FIG. 7 are perspective and end elevational views respectively illustrating in the FIGS. 7A, 7B thereof different end termination assemblies of the upstanding, vertically-movable and negatively-buoyant apertured sections implemented with flexible horizontal support members of the shoreline erosion-reversing system and method of the present invention.
Figure 7B:
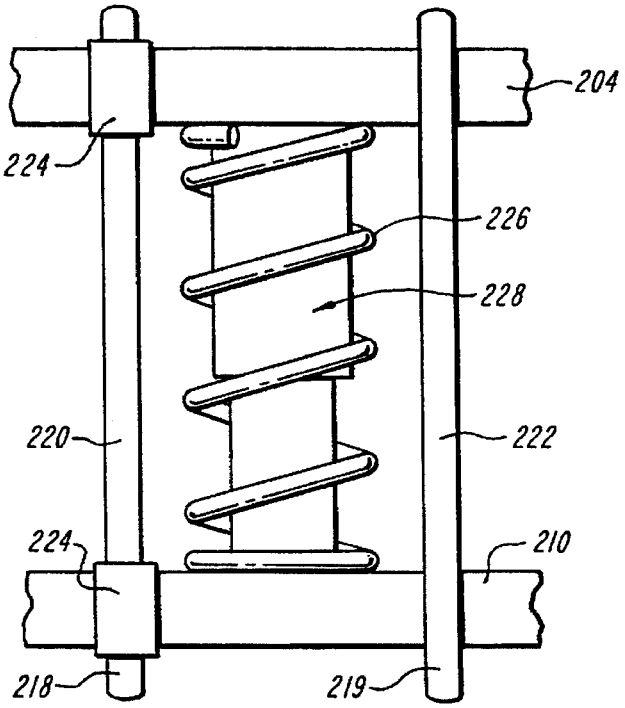

Referring now to FIG. 7, generally designated at 190 in FIG. 7A is a perspective view and generally designated at 192 in FIG. 7B is an end elevational view of different end termination assemblies of upstanding, vertically-movable and negatively-buoyant apertured sections implemented with flexible horizontal support members of the shoreline erosion-reversing system and method of the present invention. As shown in FIG. 7A, the end termination assembly 190 includes an end pile structure generally designated 194 that is comprised of four (4) piles 196 driven into the shoreline to be protected and so arrayed that each pile thereof lies along another edge of a rectangular solid. Strengthening ties 200 may be provided between the piles 196. The ties may be attached thereto either permanently or may be fixtured for adjustment or seasonal or at will removal. Although an end pile termination assembly 194 having four (4) piles is illustrated, two (2) may be employed as well.

Top flexible horizontal support member 202 that may be implemented as a single cable is securely attached to crossbar 204 as by welds or mechanical fixtures 212, and bottom flexible horizontal support member that may be implemented as a pair of flexible cables 206, 208 is securely attached to crossbar 210 as by welds or mechanical fixtures 214 on the crossbar 210. The waterwaves of a storm cyclically pulse between incoming and outgoing water. As the incoming water strikes the one or more upstanding, vertically-movable and negatively-buoyant sections borne by the top and bottom flexible cables 202, 206, 208, a tension is produced which draws the crossbars 204, 210 against the support piers 214. As the incoming water withdraws, the tension on the crossbars 204, 210 is released. As the tension thereon is imposed and released due to the cyclic pulsing of the storm, the crossbars 204, 210 are freed to move downwardly along the piles 196 by a racheting action should any undermining of the soil along the bottom edge of any of the upstanding, vertically-movable and negatively-buoyant apertured sections result by scouring action of the storm. Braces 216, either rigid or flexible, may be mechanically attached to the end termination assembly to strengthen the piles thereof. The crossbars 204, 210 may be tied together by a section 217 such that they move as a sliding unit along the piles 196.

As shown in FIG. 7B, end termination assembly 192 includes piles 218, 219, and top crossbar 204 and bottom crossbar 210 that bear against the confronting piles 218, 219 and to which one or more upstanding, vertically-movable and negatively-buoyant apertured sections implemented by flexible cable are terminated as in the embodiment 190 of FIG. 7A. The end termination assembly 192 differs from that of the FIG. 7A in that, instead of terminating the upper and lower horizontal support members respectively to the upper and lower crossbars 204, 210 as in the embodiment of the FIG. 7A, the cables that comprise the horizontal support members are continuously looped around the horizontal crossbars 204, 210 as illustrated at 220, 222. Sleeves 224 may be provided about the crossbars 204, 210 to facilitate the rolling motion of the cables 220, 222 over the crossbars 204, 210. A tension spring 226 slidably mounted over a telescopic assembly generally designated 228 is mounted between the crossbars 204, 210.

It may be desirable to attenuate tension loads on the top and bottom horizontal support members at points therealong intermediate the end pile termination assemblies. To this end, a crossbar, not shown, may be attached to either or both the top and bottom horizontal support members at one or more points intermediate its ends, which slides against piles, not shown, provided therefor to attenuate tension in either or both directions of elongation of the top and/or bottom horizontal support members.

In operation, the flexible cables 220, 222 are able to roll and slide over the crossbars 204, 210. Should one or more of the upstanding, vertically-movable and negatively-buoyant apertured sections supported thereby cant, as a result of un-even scouring of the beach under one or more of the sections during a storm, the lattice of slats of each of the sections would deform to a generally parallelogram shape, now shown, as the cables 220, 222 are caused by the unbalanced forces produced thereby to roll over the crossbars 204, 210. As the tension on the crossbars is imparted and withdrawn cyclically with the pulsations of the incoming and outgoing waterwaves incident to the one or more sections, the tension spring 226 and cooperative telescopic assembly 228 allow the one or more upstanding, but cantable, sections to ratchet downwardly into the soil so that the bottom edges thereof always maintain contact with the underlying soil of the shore.

Figure 8A:
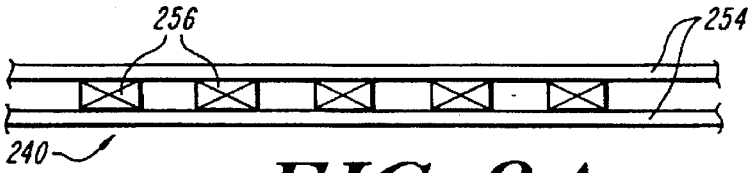
FIG. 8 are plan schematic diagrams illustrating in the FIGS. 8A, 8B, 8C and 8D thereof different lattice and horizontal support member mechanical attachment configurations, and are partial perspective views illustrating in the FIGS. 8E, 8F and 8G thereof additional lattice and horizontal support member mechanical attachment configurations of the upstanding, vertically-movable and negatively-buoyant apertured sections of the shoreline erosion-reversing system and method of the present invention.
Figure 8B:
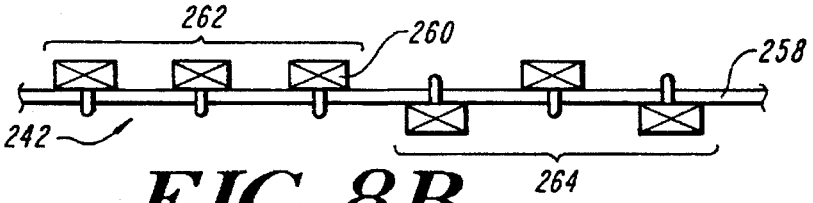
Figure 8C:
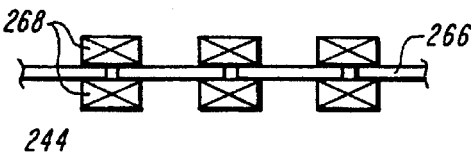
Figure 8D:
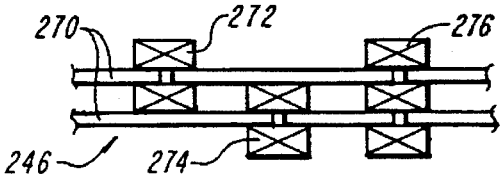
Figure 8E:
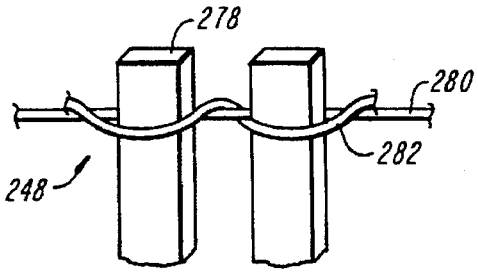
Figure 8F:
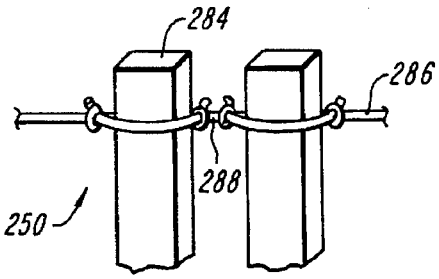
Figure 8G:
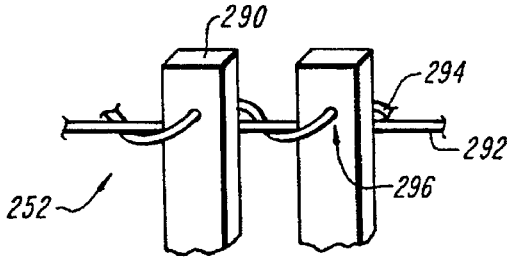

Referring now to FIG. 8, generally designated at 240, 242, 244, and 246 are schematic plan diagrams respectively illustrating in the FIGS. 8A, 8B, 8C and 8D thereof different lattice and horizontal support member mechanical attachment configurations and generally designated at 248, 250, and 252 are partial perspective views in the FIGS. 8E, 8F, and 8G illustrating additional lattice and horizontal support member mechanical attachment configurations of the upstanding, vertically-movable and negatively-buoyant apertured sections of the shoreline erosion-preventing system and method of the present invention. As shown at 240 in FIG. 8A, whenever dual horizontal support members 254 are employed for any embodiment of the upstanding, vertically-movable and negatively-buoyant apertured sections of the present invention, a lattice of single slats 256 may be mounted by means, such as bolts, welds, wire-wraps, weaving, threading or clamps, in the interspace between the two horizontal support members.

As shown at 242 in FIG. 8B, whenever a single horizontal support member 258 is employed for any embodiment of the upstanding, vertically-movable and negatively-buoyant apertured sections of the present invention, the lattice of slats 260 may be fastened, as by bolts, welds, wire-wraps, weaving, threading or clamps, to one side thereof as illustrated by bracket 262, or in staggered relation alternately to either side thereof, as illustrated by bracket 264.

As designated at 244 in FIG. 8C, whenever a single horizontal support 266 is employed for any embodiment of the upstanding, vertically-movable and negatively-buoyant apertured sections of the present invention, the lattice may be formed of pairs of slats 268 mounted by bolts, welds, wire-wraps, weaving, threading or clamps one to either side thereof.

As shown at 246 in FIG. 8D, whenever dual horizontal support members 270 are employed for any embodiment of the upstanding, vertically-movable and negatively-buoyant apertured sections of the present invention, the lattice of slats may be attached to either side of either horizontal support member pairwise, as illustrated at 272, 274, as well as attached triplewise to both horizontal support members, as illustrated at 276, by bolts, welds, wire-wraps, weaving, threading or clamps.

As shown at 248 in FIG. 8E, the lattice of slats 278 may be attached in spaced-apart relation to a single horizontal support member 280 by wrapping a wire 282 therearound for any embodiment of the upstanding, vertically-movable and negatively-buoyant apertured sections of the present invention. Any stiff and strong wire, such as a low gauge solid or stranded wire, may be employed.

As shown at 250 in FIG. 8F, the lattice of slats 284 may be attached to a single horizontal support member 286 by weaving a cable 288 therearound for any embodiment of the upstanding, vertically-movable and negatively-buoyant apertured sections of the present invention. Any light and flexible wire, such as rope, nylon or plastic cord, may be employed.

As shown at 252 in FIG. 8G, the lattice of slats 290 may be attached to a single horizontal support member 292 by threading a wire 294 through corresponding apertures generally designated 296 that are provided through the slats 290 and around the horizontal support member 292 for any embodiment of the upstanding, vertically-movable and negatively-buoyant apertured sections of the present invention. Any stiff and strong wire, such as a low gauge solid or stranded wire, may be employed. If the wire is weaved as well as threaded, not shown, any light and flexible wire, rope, nylon or plastic cord, may be employed.

Figure 9:
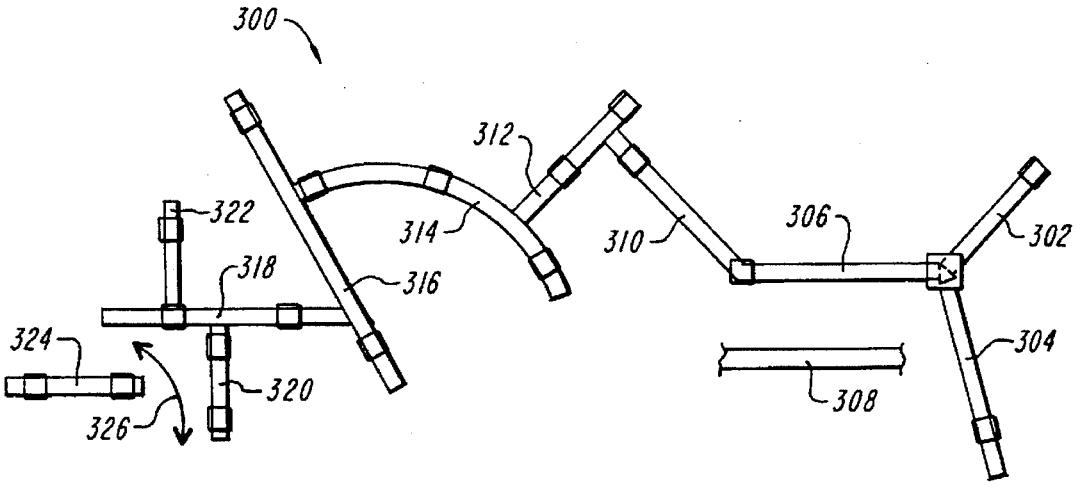
FIG. 9 is a plan schematic diagram illustrating different presently preferred array configuration embodiments of the upstanding, vertically-movable and negatively-buoyant apertured sections of the shoreline erosion-preventing system and method of the present invention.

Referring now to FIG. 9, generally designated at 300 is a plan schematic diagram illustrating different array configurations of the upstanding, vertically-movable and negatively-buoyant apertured sections of the shoreline erosion-reversing system and method of the present invention. In general, the "rectangles" in the FIG. 9 represent upstanding, vertically-movable and negatively-buoyant hydrodynamic fence subassemblies, while the "squares" thereof represent pile subassemblies, the left-hand of the page represents the "seaward" direction, while the right-hand side thereof represents the "landward" direction.

Sections 302, 304 are illustrative of sections respectively mounted at the end of a primary section 306 at an acute and at an oblique angle thereto. The sections 302, 304 cooperate with the section 306 to prevent secondary spiliback around the terminal edges of the primary section 306. The section 304 prevents the flow of water from the basin behind the primary section 306 to adjacent property, thereby helping to retain it therein, while the section 302 prevents the flow of water from the basin behind the primary section 306 to the front of the section 306. These sections 302, 304 introduce added quieting effect to the basin in the landward quiet zone by reducing localized flows that may occur in the basin. A similar effect in the seaward quiet zone can also be achieved. Note that the multiple sections 302, 304, 306 are supported by a common pile subassembly.

The section 308 spaced from and confronting the section 306 is representative of a parallel section that would provide water entrapment in a basin between it and the section 306 in the absence of a natural embankment, such as a hillside.

The section 310 meets the section 312 at an angle other than one hundred eighty (180) degrees, and, in the illustrated configuration, at a ninety (90) degree angle. Because the force on the sections varies with the cosine of the angle of the incident waterwaves, such angled sections 310, 312 may be employed where greater strength may be called for in a particular application. Note that the section 310 meets the section 312 at a point spaced from the end of the section 312, which it is representative of the fact that adjacent angled sections need not be corner-fit, but can interface at "T" intersections.

The section 314, which is arcuate, and readily implemented by the flexible horizontal support embodiments, represents that the upstanding vertically-movable and negatively-buoyant apertured sections of the shoreline erosion-reversing system and method of the present invention need not be linearly arranged, but can be arrayed about a curve. Curves may be necessary where the shoreline to be protected has boulders or other such non-movable or not easily removable beach formations.

The interface of the arcuate section 314 with that of a linear section 316 represents that upstanding, vertically-movable and negatively-buoyant apertured sections may be arrayed such that an arcuate section terminates at a "T" juncture with a linear section.

The section 318 cooperates with the orthogonal section 320 to mitigate flow-around that would be occasioned from secondary flows parallel to the fence. Section 322 has the same effect.

Section 324 and section 318 represent that sections may be spaced from other sections so as to provide easy access to the beach in other than storm conditions as illustrated by an arrow marked 326.

Many modifications of the presently disclosed invention will become apparent to those skilled in the art having benefit of the instant disclosure. For example, although double horizontal support members of the hydrodynamic fence subassemblies are implemented in lateral pairs in the disclosed embodiments, they may be vertically tiered as well. More than top and bottom horizontal support members may be employed, such as top, intermediate and bottom members. Different apertured sections may be implemented differently, either with regard to the lattice configuration, the pile configuration, or the configuration of the horizontal support members. The same and different sections can have uniform and non-uniform lattice configurations. Sections may be permanently installed by the use of welds or other permanent attachment or fabrication techniques or may be installed for seasonal, or at will, take down by use of mechanical attachment techniques. It will be appreciated that soil deposition and erosion prevention also occurs in situations other than natural storms, such as outflow of dams and local ship traffic, among other things. Other modifications will become apparent to those of skill in the art without departing from the inventive concepts.

What is claimed is:

1. A shoreline erosion-reversing system, comprising:

a series of one or more upstanding, vertically-movable and negatively-buoyant apertured sections having generally quadrilateral front and rear faces and a bottom edge, whose bottom edges always rest on the underlying seashore, so arrayed on the shoreline to be protected that the front faces of at least one section generally faces seaward and the corresponding rear face of each such at least one section generally faces landward to confront an upstanding element in spaced-apart relation therewith to define a basin therebetween;

each such at least one upstanding section has first solid portions which act to attenuate upon impact the energy of the waterwaves of a storm;

each such upstanding apertured section both has first apertures that permit a portion of the water of the waterwaves of a storm incident to each such section to pass therethrough to the basin in proportion to the intensity of the storm and has second solid portions cooperative therewith to temporarily retain the same in the basin so as to provide a body of water in the basin whose mass at any time varies with the intensity of the incident storm and whose inertia dissipates the energy of the waterwaves of a storm as the inertial mass of water is moved thereby in proportion to its intensity creating a landward "quiet" zone between each such section and its corresponding upstanding element in which soil entrained in the body of water temporarily held in the basin deposits on the landward side of each such section; and each such section has second apertured portions that allow the water in the basin to flow from the basin seaward back through each such section and into the oncoming water of the storm as a back-current which turbulently cancels the same creating a "quiet" zone seaward of each such section in which erosive effects of the storm are mitigated.

2. The invention of claim 1, wherein one of said one or more sections is a linear section.

3. The invention of claim 1, wherein one of said one or more sections is an arcuate section.

4. The invention of claim 1, wherein said series of one or more sections has two or more sections, and wherein two of said two or more sections meet at an angle.

5. The invention of claim 4, wherein said angle is an acute angle.

6. The invention of claim 4, wherein said angle is a right angle.

7. The invention of claim 6, wherein said right angle defines a "T" between said two sections.

8. The invention of claim 4, wherein said angle is an obtuse angle.

9. The invention of claim 1, wherein said series of one or more sections has two or more sections, and wherein two of said two or more sections are partially overlapping.

10. The invention of claim 1, wherein said series of one or more sections has two or more sections, and wherein two of said two or more sections have adjacent ends that are in a confronting relation defining a gap therebetween.

11. The invention of claim 1, wherein said upstanding element is a naturally occurring upstanding element.

12. The invention of claim 1, wherein said upstanding element is a man-made element.

13. The invention of claim 12, wherein said man-made element is another section.

14. The invention of claim 1, further including an upstanding, positively-buoyant apertured section in back-to-back relation with at least one of said each such apertured section.

15. The invention of claim 1, wherein each said at least one such section is comprised by a pile subassembly and a hydrodynamic fence subassembly having a lattice of slats having tops and bottoms and so mounted between top and bottom horizontal support members as to define interslat interspaces therebetween, wherein said first solid portions are provided by a portion of said slats that extends from the tops thereof towards the bottoms, wherein said second solid portions are provided by a portion of said slats that extend from the bottoms thereof towards the tops thereof, wherein said first apertured portions are provided by a portion of the interslat interspaces that extend from the tops thereof towards the bottoms and wherein said second apertured portions are provided by a portion of said interslat interspaces that extend from the bottoms thereof towards the tops thereof.

16. The invention of claim 15, wherein said pile subassembly consists of a single elongated pile driven into the shoreline, and further including a bracket member orthogonally attached to said top horizontal support member which slidably receives said single pile and provides a linear bearing along which the hydrodynamic fence subassembly is free to slide along the direction of elongation of the single pile.

17. The invention of claim 16, wherein said horizontal support members are rigid.

18. The invention of claim 16, wherein said horizontal support members are flexible.

19. The invention of claim 18, further including an end assembly for terminating flexible horizontal support members.

20. The invention of claim 19, wherein said end assembly includes an end pile subassembly having at least two elongated end piles driven in generally parallel relation into the shoreline to be protected and a top and a bottom crossbar attached to the flexible top and bottom horizontal support members, wherein said elongated end piles provide a linear bearing along which the top and bottom crossbars are free to move along the direction of elongation of the piles.

21. The invention of claim 19, wherein said end assembly includes an end pile subassembly having at least two elongated end piles driven in generally parallel relation into the shoreline to be protected and a slide subassembly having top and bottom crossbars each having ends, wherein said top and bottom flexible horizontal support members are continuously looped about the free ends of the top and bottom crossbars and wherein said elongated end piles provide a linear bearing along which said slide subassembly is free to move along the direction of elongation of the piles.

22. The invention of claim 21, further including a spring-loaded telescoping subassembly mounted between the two crossbars.

23. The invention of claim 16, wherein at least one of said top and bottom horizontal members is singly constituted.

24. The invention of claim 15, wherein said pile subassembly consists of two elongated piles driven in generally parallel relation into the shoreline so as to define an interpile interspace therebetween, and wherein said interpile interface provides a linear bearing which slidably receives said top and bottom horizontal support members along which the hydrodynamic fence subassembly is free to slide along the direction of elongation of the two generally parallel piles.

25. The invention of claim 24, wherein said horizontal support members are rigid.

26. The invention of claim 24, wherein said horizontal support members are flexible.

27. The invention of claim 26, further including an end assembly for terminating flexible horizontal support members.

28. The invention of claim 27, wherein said end assembly includes an end pile subassembly having at least two elongated end piles driven in generally parallel relation into the shoreline to be protected and a top and a bottom crossbar attached to the flexible top and bottom horizontal support members, wherein said elongated end piles provide a linear bearing along which the top and bottom crossbars are free to move along the direction of elongation of the piles.

29. The invention of claim 27, wherein said end assembly includes an end pile subassembly having at least two elongated end piles driven in generally parallel relation into the shoreline to be protected and a slide subassembly having top and bottom crossbars each having ends, wherein said top and bottom flexible horizontal support members are continuously looped about the free ends of the top and bottom crossbars and wherein said elongated end piles provide a linear bearing along which said slide subassembly is free to move along the direction of elongation of the piles.

30. The invention of claim 29, further including a spring-loaded telescoping subassembly mounted between the two crossbars.

31. The invention of claim 24, wherein at least one of said top and bottom horizontal members is singly constituted.

32. The invention of claim 15, wherein one of said top and bottom horizontal support members is a single member, and wherein said lattice is mounted to one side thereof.

33. The invention of claim 15, wherein one of said top and bottom horizontal support members is a single member, and wherein said lattice is mounted to both sides thereof.

34. The invention of claim 15, wherein one of said top and bottom horizontal support members is a single member, and wherein said lattice is mounted to alternative sides thereof.

35. The invention of claim 15, wherein one of said top and bottom horizontal support members is a double member, and wherein said lattice is mounted therebetween.

36. The invention of claim 15, wherein one of said top and bottom horizontal support members is a double member, and wherein said lattice is mounted to one member of said double member.

37. The invention of claim 15, wherein one of said top and bottom horizontal support members is a double member, and wherein said lattice is mounted to both members of said double member.

38. The invention of claim 15, wherein said lattice is mounted by bolts.

39. The invention of claim 15, wherein said lattice is mounted by wire wraps.

40. The invention of claim 15, wherein said lattice is mounted by threading.

41. The invention of claim 15, wherein said lattice is mounted by weaving.

42. A shoreline erosion-reversing method comprising the steps of:

arraying a series of one or more upstanding, negatively-buoyant and vertically-movable apertured sections having generally quadrilateral front and rear faces, a bottom edge, first and second solid portions and first and second apertured portions on the shoreline to be protected in such a way that the front faces of at least one section generally faces seaward, the bottom edge of each of said at least one upstanding, negatively-buoyant and vertically-movable apertured section rests on the underlying shoreline, and the corresponding rear face of each such at least one section faces landward and confronts an upstanding element in spaced-apart relation therewith to define a basin therebetween;

allowing the waterwaves of a storm to impact the first solid portions of said at least one upstanding, apertured section so as to attenuate the energy of the waterwaves of a storm;

allowing the water of the waterwaves of the storm incident to each such section to pass through the first apertured portions of each such at least one section into the basin in proportion to the intensity of the storm while allowing the second solid portions of each such at least one apertured section to temporarily retain the same in the basin and form thereby a body of water in the basin whose mass at any time varies with the intensity of the incident storm and whose inertia dissipates the energy of the waterwaves of the storm as the inertial body of water in the basin is moved thereby in proportion to the intensity of the storm creating a landward "quiet" zone between each such section and the corresponding upstanding element in which soil entrapped in the body of water temporarily held in the basin is deposited on the landward side of each such at least one apertured section; and allowing the second apertured portions of each such at least one apertured section to pass the water in the basin back from the basin seaward back through each such at least one apertured section and into the oncoming waterwaves of the storm forming thereby a back-current which turbulently cancels the same creating a "quiet" zone seaward of each such section which mitigates shoreline erosion seaward of each said at least one apertured section.

43. The invention of claim 42, wherein said upstanding element is a natural element.

44. The invention of claim 43, wherein said upstanding man-made element is another section.

45. The invention of claim 42, wherein said upstanding element is a man-made element.

46. The invention of claim 42, further including the step of arraying one or more sections with said series of sections so as to help retain the water in the basin and quiet the waters in one of the landward and seaward directions about said series of sections.

47. A freely-movable apertured section of a shoreline erosion-reversing system, comprising:

a hydrodynamic fence subassembly having a lattice of slats fastened in spaced apart relation to top and bottom horizontal support members;

first and second pile subassemblies each having first and second elongated piles spaced-apart in generally-parallel relation and defining an interpile interspace therebetween;

said hydrodynamic fence subassembly cooperates with said first and second pile subassemblies such that said first and second piles of each of said first and second pile subassemblies provide linear bearings for said top and bottom horizontal support members which supports the hydrodynamic fence subassembly for binding-free motion along the direction of elongation thereof.

48. The invention of claim 47, wherein at least one of said top and bottom horizontal support members is a flexible member.

49. The invention of claim 47, wherein at least one of said top and bottom horizontal support members is a rigid member.

50. The invention of claim 47, wherein at least one of said top and bottom horizontal support members is constituted by a single member.

51. The invention of claim 47, wherein at least one of said top and bottom horizontal support members is constituted by a double member.

52. The invention of claim 47, wherein said hydrodynamic fence subassembly is negatively buoyant.

53. The invention of claim 47, wherein said hydrodynamic fence subassembly is positively buoyant.

* * * * *